US005164704A

United States Patent [19]

Steen et al.

[11] Patent Number: 5,164,704

[45] Date of Patent: Nov. 17, 1992

[54] SYSTEM FOR TRANSMITTING ALARM SIGNALS WITH A REPETITION

[75] Inventors: Petrus A. J. Steen, Bargercompascuum; Gauke K. Zijlstra, Emmen, both of Netherlands

[73] Assignee: Ericsson Radio Systems B.V., Emmen, Netherlands

[21] Appl. No.: 669,886

[22] Filed: Mar. 14, 1991

[30] Foreign Application Priority Data

Mar. 16, 1990 [NL] Netherlands ..... 9000606

[51] Int. Cl.[5] ..... G08B 1/08

[52] U.S. Cl. ..... 340/539; 340/531

[58] Field of Search ..... 340/539, 531, 506; 455/9, 65, 63, 67

[56] References Cited

U.S. PATENT DOCUMENTS

| | | | |
|---|---|---|---|
| 3,623,876 | 11/1986 | Shima et al. | 340/539 |
| 4,101,872 | 7/1978 | Pappas | 340/539 |
| 4,347,501 | 8/1982 | Akerberg | 340/539 |
| 4,442,426 | 4/1984 | Heuschmann et al. | 340/539 |
| 4,462,022 | 7/1984 | Stolarczyk | 340/539 |
| 4,661,804 | 4/1987 | Abel | 340/539 |
| 4,734,680 | 3/1988 | Gehman et al. | 340/539 |
| 5,004,999 | 4/1991 | Hartmann et al. | 340/539 |

FOREIGN PATENT DOCUMENTS

| | | |
|---|---|---|
| 475417 | 5/1975 | Australia . |
| 0100523 | 2/1984 | European Pat. Off. . |
| 0312431 | 4/1989 | European Pat. Off. . |
| 0368710 | 5/1990 | European Pat. Off. . |
| 2186404 | 8/1987 | United Kingdom . |
| 2212642 | 7/1989 | United Kingdom . |

*Primary Examiner*—Donnie L. Crosland

*Attorney, Agent, or Firm*—Burns, Doane, Swecker and Mathis

[57] ABSTRACT

System for transmitting alarm signals, comprising at least one portable transmitting unit and one central receiver, the transmitting unit comprising a control circuit which is connected to an activation device and a transmitting circuit, the control circuit activating the transmitting circuit when the activation device is energized in order to transmit an alarm signal and in order to re-activate the transmitting circuit for the re-transmission of the alarm signal after the elapse of a delay time, the delay time being different from a delay time of another transmitting unit, the transmitting unit having a memory for storing an identification code allocated to the transmitting unit, the central receiver comprising a processing system which is connected to a receiving circuit which is suitable for receiving an alarm signal and the processing circuit activating a signalling device, on receipt of an alarm signal, for the purpose of generating an attention signal, in which system the delay time is dependent on corresponding sections having different values of identification codes allocated to a predetermined group of transmitting units.

4 Claims, 1 Drawing Sheet

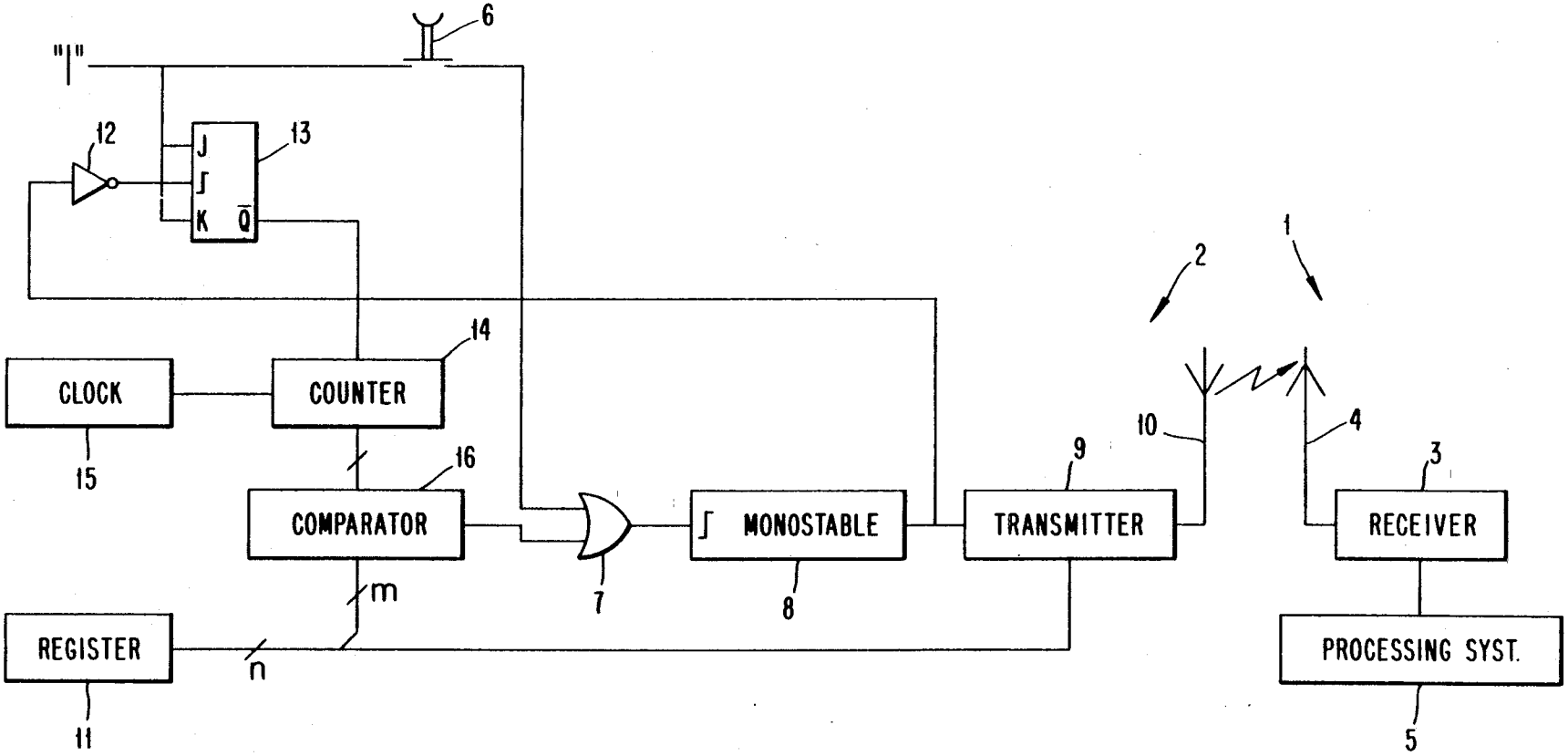
RECEIVER
PROCESSING SYST.
TRANSMITTER
MONOSTABLE
COUNTER
COMPARATOR
CLOCK
REGISTER
"1"
J
K
Q
m
n
1
2
3
4
5
6
7
8
9
10
11
12
13
14
15
16

SYSTEM FOR TRANSMITTING ALARM SIGNALS WITH A REPETITION

BACKGROUND OF THE INVENTION

The invention relates to a system for transmitting alarm signals comprising at least one portable transmitting unit and one central receiver, the transmitting unit comprising a control circuit which is connected to an activation device and a transmitting circuit, the control circuit activating the transmitting circuit when the activation device is energized in order to transmit an alarm signal and in order to re-activate the transmitting circuit for the re-transmission of the alarm signal after the elapse of a delay time, the delay time being different from a delay time of another transmitting unit, the transmitting unit having a memory for storing an identification code allocated to the transmitting unit, the central receiver comprising a processing system which is connected to a receiving circuit which is suitable for receiving an alarm signal and the processing circuit activating a signalling device, on receipt of an alarm signal, for the purpose of generating an attention signal.

A system of this type is disclosed by the U.S. Pat. No. 4,347,501. In the known system, the activation device is a switch to be operated by a user of the transmitting unit. The delay times of all the transmitting units are different. This is intended to reduce the possibility that alarm signals transmitted by different transmitting units overlap one another and thereby interfere with their reception in the central receiver if the users of said transmitting units operate the switch of their transmitting unit approximately at the same instant. Operation of the switch approximately simultaneously may occur, for example, in an alert situation which is observed by different users of such transmitting units. In this connection, depending on the use of the system, a very serious situation may arise if none of the alarm signals transmitted approximately simultaneously is received well by the central receiver.

The known system has the drawback that a large number of different delay times, which therefore comprise a number of relatively long delay times, has to be used, as a result of which it may be a relatively long time before a transmission of an alarm signal is repeated, and this is very undesirable in some alert situations.

SUMMARY OF THE INVENTION

The invention is based on the insight that in practice certain situations are monitored essentially by a certain group of users of portable alarm transmission units, as a result of which it may be sufficient in practice that only the delay times of the transmission units of the users of such a particular group are different.

The object of the invention is to provide a solution to this problem.

For this purpose, the system of the type mentioned in the preamble, according to the invention is characterized in that the delay time is dependent on corresponding sections having different values of identification codes allocated to a predetermined group of transmitting units.

This ensures in a simple way that the delay times of such a predetermined group of transmitting units are different and, consequently, that the overlapping transmission of alarm signals by the transmitting units of the group is expediently counteracted. The number of different delay times of all the transmitting units of the system can in this case be small and the delay times can be kept relatively short.

If the least-significant sections of the identification codes of the predetermined group of transmitting units are different, in particular because consecutive identification numbers have been given to said transmitting units, it is beneficial if the delay time depends on the least-significant section of the identification code. As a result of this, a simple implementation can be obtained in which a value of an elapsed section of the delay time is compared with the least-significant section and in which the delay is terminated in the event of equality.

The delay time can also be determined by processing the identification code with a predetermined algorithm. In this case, sections of the identification code can be processed arithmetically in a manner such that the delay times of the transmitting units of the predetermined group are different with a relatively high reliability.

BRIEF DESCRIPTION OF THE DRAWING

The drawing FIGURE shows a representation of the presently preferred embodiment of the invention.

DETAILED DESCRIPTION OF A PREFERRED EMBODIMENT

The invention is explained with reference to the drawing.

The drawing shows a central receiver 1 and a portable transmitting unit 2 of a number of portable transmitting units 2 of the system according to the invention. The central receiver 1 comprises a receiving circuit 3 to which an aerial 4 is connected and which has an output which is connected to an input of a processing system 5. The processing system 5 may be a simple circuit for generating an attention signal on receipt of an alarm signal by the receiving circuit 3 or it may be a telephone exchange for transmitting an alarm signal received or it may comprise a computer for processing an alarm signal received.

The embodiment shown in the drawing of the portable transmitting unit 2 comprises a switch 6 which is intended to be operated by the user of the transmitting unit 2, and one terminal of which is connected to a point having a logically high ("1") level and another terminal of which is connected to an input of an OR gate 7. An output of the OR gate 7 is connected to a trigger input of a monostable multivibrator 8 which is triggered by a rising edge of the signal supplied to the trigger input thereof and, in response thereto, delivers a signal having a logically high level for a predetermined time to an output. The output of the monostable multivibrator 8 is connected to a transmitting circuit 9 which is connected to an aerial 10. A group of inputs of the transmitting circuit 9 receives an identification code or identification number allocated to the transmitting unit 2 and stored in a register 11 via n lines. If the signal delivered by the monostable multivibrator 8 to the transmitting circuit 9 is logically high, the transmitting circuit 9 transmits an alarm signal which contains the identification code.

The output of the monostable multivibrator 8 is also connected via an inverter 12 to a clock input of a JK flip-flop 13 which is triggered at rising edges of the signal delivered at its clock input. The J input and the K input are each connected to the source having a logically high level. An inverting output $\overline{Q}$ of the flip-flop 13 is connected to a reset input of a counting circuit 14. On initialization of the transmitting unit 2 and in the quiescent state of the transmitting unit 2, the $\overline{Q}$ output of the flip-flop 13 has a logically high level, in which case it holds the counting circuit 14 at the counter reading 0, or in general, at an initial reading.

A clock input of the counting circuit 14 is connected to an output of a clock generator 15. A group of outputs for the counter reading of the counting circuit 14 is connected to a corresponding group of inputs of a comparator 16, another group of inputs of which is connected to a number m of lines having consecutive, in particular least-significant values of the n lines which are connected to the outputs of the register 11.

Starting from an initialization state or quiescent state of the transmitting unit 2, its operation is as follows:

If the user of the transmitting unit 2 operates the switch 6, the monostable multivibrator 8 is triggered and its output signal consequently becomes high, as a result of which the transmitting circuit 9 transmits an alarm signal which contains the identification code read out of the register 11.

After the transmission has elapsed, in particular after the elapse of the time predetermined by the monostable multivibrator 8, the output signal of the monostable multivibrator 8 becomes low, thereby triggering the JK flip-flop 13, as a result of which the inverting output $\overline{Q}$ becomes low and the counting circuit 14 is consequently able to count the clock pulses received from the clock generator 15.

If the counter reading of the counting circuit 14 is equal to the value which is presented by the m inputs of the comparator 16 which are connected to the register 11, the comparator 16 delivers an output signal having a high level, as a result of which the monostable multivibrator 8 is again triggered and the transmitting circuit 9 will consequently transmit the same alarm signal yet again.

When the output signal of the monostable multivibrator 8 becomes low for the second time after the operation of the switch 6, the flip-flop 13 is triggered for the second time, as a result of which the flip-flop 13 returns to its state in which its inverting output $\overline{Q}$ is high, thereby resetting the counting circuit 14 to zero. The transmitting unit 2 is then back in the quiescent state.

The maximum delay time which can be obtained by means of the embodiment of the transmitting unit 2 shown depends on the number m of inputs of the comparator 16 which are connected to the register 11. The smallest difference between the various delay times is at the same time equal to the period of the clock pulses delivered by the clock generator 15. In order to counteract overlapping of alarm signals transmitted by different transmitting units 2, the period of the clock pulses generated by the clock generator 15 must be at least as great as the transmitting time of an alarm signal, which at most lasts as long as the time predetermined by the monostable multivibrator 8 for which its output is high.

It is pointed out that the identification code or the identification number in the register 11 can have binary-decimal coding. The numbers m and n are then multiples of 4 and a BCD counter is then chosen for the counting circuit 14.

As an alternative, the m lines do not have to be lines having consecutive order numbers. A condition is only that the m lines for different transmitting units of a predetermined group of transmitting units indicate different values.

Within the scope of the invention it is also possible to process the sections of the identification code or the identification number of a transmitting unit with a predetermined algorithm, with, for example, addition of figures, and to make the delay time dependent on a result following from the processing.

Instead of using a monostable multivibrator to determine the start and the finish of a transmission, a start pulse occurring at the start of the propagation and a finish pulse occurring at the end of the transmission which are delivered, for example, by an asynchronous transmitting circuit, known per se, having a binary parallel/series converter, may also be used.

Finally, it is pointed out that the transmitting unit 2 may comprise a microprocessor, as a result of which the invention can also be implemented by using a suitable program.

What is claimed is:

1. A system for transmitting alarm signals comprising at least one portable transmitting unit and one central receiver, said transmitting unit comprising an activation device, a transmitting circuit, a memory for storing an identification code allocated to the transmitting unit, and a control circuit, connected to said activation device and said transmitting circuit, for activating the transmitting circuit when the activation device is energized in order to transmit an alarm signal comprising said identification code and in order to re-activate the transmitting circuit for the re-transmission of the alarm signal after the elapse of a delay time, the delay time being different from a delay time of another transmitting unit, wherein the delay time is dependent on corresponding sections of identification codes allocated to a predetermined group of transmitting units having different values and in which the delay time is zero, or at least as long as a transmission time of the alarm signal, said central receiver comprising a receiving circuit suitable for receiving an alarm signal, a processing system, connected to said receiving circuit, for activating a signalling device, on receipt of an alarm signal, for the purpose of generating an attention signal.

2. A system according to claim 1, wherein least-significant sections of the identification codes of the predetermined group of transmitting units are different, wherein the delay time is dependent on the least-significant section.

3. A system according to claim 1, wherein the delay time is determined by processing the identification code with a predetermined algorithm.

4. A system according to claim 2, wherein the delay time is determined by processing the identification code with a predetermined algorithm.

* * * * *